United States Patent [19]

Russell

[11] 4,070,975

[45] Jan. 31, 1978

[54] RUFFLER ATTACHMENT FOR SEWING MACHINE

[75] Inventor: Richard Russell, Tappan, N.Y.

[73] Assignee: U.S. Blind Stitch Machine Corporation, Plainview, N.Y.

[21] Appl. No.: 635,568

[22] Filed: Nov. 26, 1975

[51] Int. Cl.[2] ..... D05B 35/08

[52] U.S. Cl. ..... 112/135

[58] Field of Search ..... 112/132, 134, 135, 133

[56] References Cited

U.S. PATENT DOCUMENTS

| | | | |
|---|---|---|---|
| 837,668 | 12/1906 | DeVoe | 112/132 |
| 1,412,903 | 4/1922 | Thomas | 112/135 |
| 2,086,038 | 7/1937 | Kucera | 112/132 |
| 2,108,403 | 2/1938 | Edwards | 112/132 |
| 2,881,724 | 4/1959 | Cremer et al. | 112/132 X |
| 2,915,997 | 12/1959 | Seaman | 112/132 |

*Primary Examiner*—H. Hampton Hunter

*Attorney, Agent, or Firm*—Blum, Moscovitz, Friedman & Kaplan

[57] ABSTRACT

A ruffler attachment for a sewing machine, the operation of which is synchronized with the main sewing machine driving mechanisms, and facilitates adjustment of the size of the ruffle, and the number of ruffles to be formed, is provided. The ruffler attachment is characterized by a stiffener blade disposed to permit a body material to be introduced thereunder into the sewing displacement position of the needle to effect sewing of the body material. A feeder is provided for feeding and guiding a trim material to be ruffled into contact with the stiffener blade. A ruffler blade is coordinately displaceable from a first position wherein the ruffler blade is in contact with the stiffener blade to a ruffle forming position proximate the needle sewing position. The ruffler blade effects a sandwiching of the trim material between the ruffler blade and stiffener blade at the first contact position of the ruffler blade and folds a portion of the trim material between the first contact position of the ruffler blade and the sewing position of the needle under the remaining portion of the trim material between the first contact position and the sewing position of the needle.

7 Claims, 8 Drawing Figures

32
25
26
22
31
33
34
23
20
28
30
38
39
40
41

RUFFLER ATTACHMENT FOR SEWING MACHINE

BACKGROUND OF THE INVENTION

This invention is directed to a ruffler attachment for a sewing machine, and in particular to a ruffler attachment for a sewing machine, which attachment is coupled to the main drive of a sewing machine and is operated in synchronism with the sewing machine thereby. While ruffler attachments for sewing machines have taken on various forms, the difficulties encountered in synchronizing the operation of the ruffler attachment with the sewing operation of the machine, and the difficulties in altering or redesigning the sewing machine to add such ruffler attachments has rendered same less than completely satisfactory. Specifically, the difficulties in effecting the necessary synchronization between the ruffle forming apparatus, wherein a trim fabric is pleated and sewn to a body fabric, with the sewing operation of the sewing machine has rendered the adjustment in size of the ruffle formed in the trim fabric, and the number of ruffles to be formed over a predetermined length of body fabric to require extensive, time-consuming and otherwise expensive adjustments to the sewing machine and ruffler attachment mechanisms.

SUMMARY OF THE INVENTION

Generally speaking, in accordance with the invention, a ruffler attachment driven by the main rotary drive of the sewing machine and thereby synchronized with respect to the sewing operation thereof is provided. The sewing machine operation is performed by a needle mechanism including a needle, the needle mechanism effecting periodic sewing displacement of the needle into a material to effect sewing of same and a feed dog mechanism including a feed dog disposed with respect to the needle to effect periodic displacement of the material after each sewing of same by the needle. The needle mechanism and feed dog mechanism are coupled to the sewing machine rotary drive and the operations thereof are synchronized thereby. The ruffler attachment includes a stiffener blade disposed to permit a body material to be introduced into the sewing position of the needle and a feeder is provided for feeding a trim material into contact with the stiffener blade. A ruffler blade is provided and is coordinately displaceable from a first position, wherein the ruffler blade is in contact with the stiffener blade to a ruffle forming position proximate the sewing position of the needle, the ruffler blade and stiffener blade being constructed and arranged to sandwich the trim material between the ruffler blade and the stiffener blade at the first contact position of the ruffler blade to effect a folding of a portion of the trim material between the first contact position of the ruffler blade and the ruffle forming position of the ruffler blade under the remaining portion of the trim material between the first contact position and ruffle forming position and into the sewing position of the needle. An oscillatory drive mechanism is coupled to the ruffler blade and to the sewing machine rotary drive for synchronizing the coordinate displacement of the ruffler blade from the first contact position to the ruffle forming position with the periodic sewing displacement of the needle and periodic displacement of the fabric by the feed dog.

In a preferred embodiment, the oscillatory drive mechanism includes calibration means for adjusting distance through which the ruffler blade is coordinately displaced, and hence the length of each ruffle pleat formed. A further feature permits interchangeable drive pulleys to be utilized with the oscillatory drive mechanism to adjust the number of ruffles to be formed during each sewing displacement of the needle and hence adjust the number of ruffles to be formed along the length of body material to be trimmed.

Accordingly, it is an object of the instant invention to provide an improved ruffler attachment for a sewing machine.

Still a further object of the instant invention is to provide an improved ruffler attachment for a sewing machine, wherein the ruffler attachment is driven by the sewing machine drive mechanism and is synchronized with the sewing machine operation thereby.

Still a further object of the instant invention is to provide a ruffler attachment wherein the number of ruffles formed along a predetermined length of body material and the length of each ruffle formed is readily adjusted.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

Figure 1:
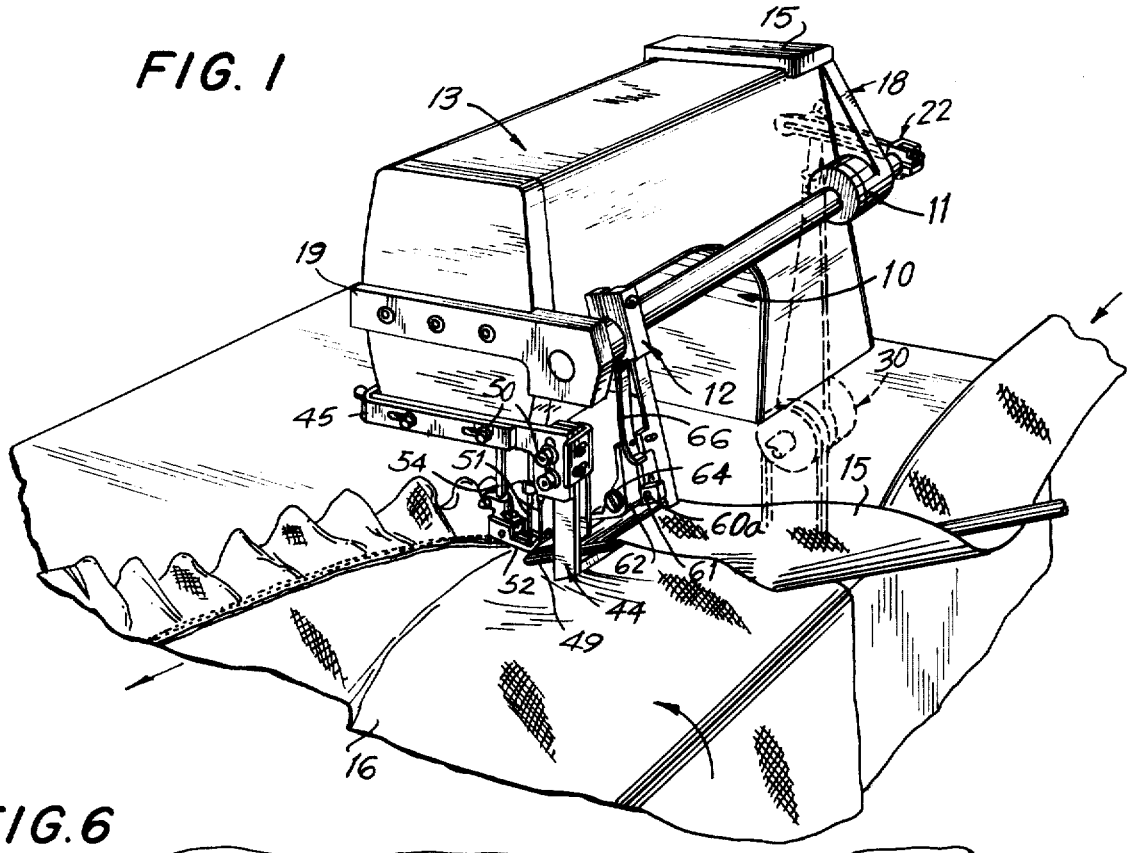
FIG. 1 is a perspective view of a sewing machine ruffler attachment constructed in accordance with a preferred embodiment of the instant invention.

Reference is now made to FIG. 1, wherein a ruffler attachment, generally indicated at 10, having an oscillatory drive mechanism, generally indicated as 11, and a ruffler assembly, generally indicated as 12, is mounted to a sewing machine, generally indicated as 13. The ruffler attachment is adapted to sew a strip of trim fabric 15, to the edge of a body fabric 16, in such a manner as to form ruffles in the trim fabric. As is well known in the art, such ruffles are defined by forming widthwise pleats along the length of the trim fabric as the trim fabric is joined to the body fabric.

Figure 3:
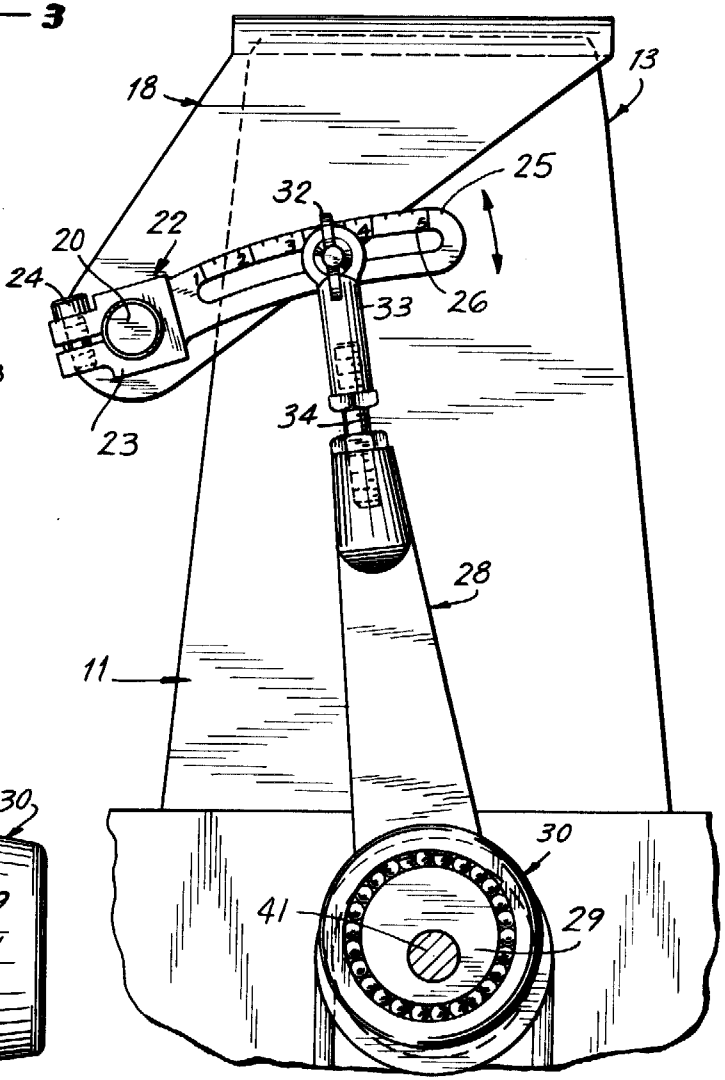
FIG. 3 is a sectional view taken along line 3—3 of FIG. 2.
Figure 2:
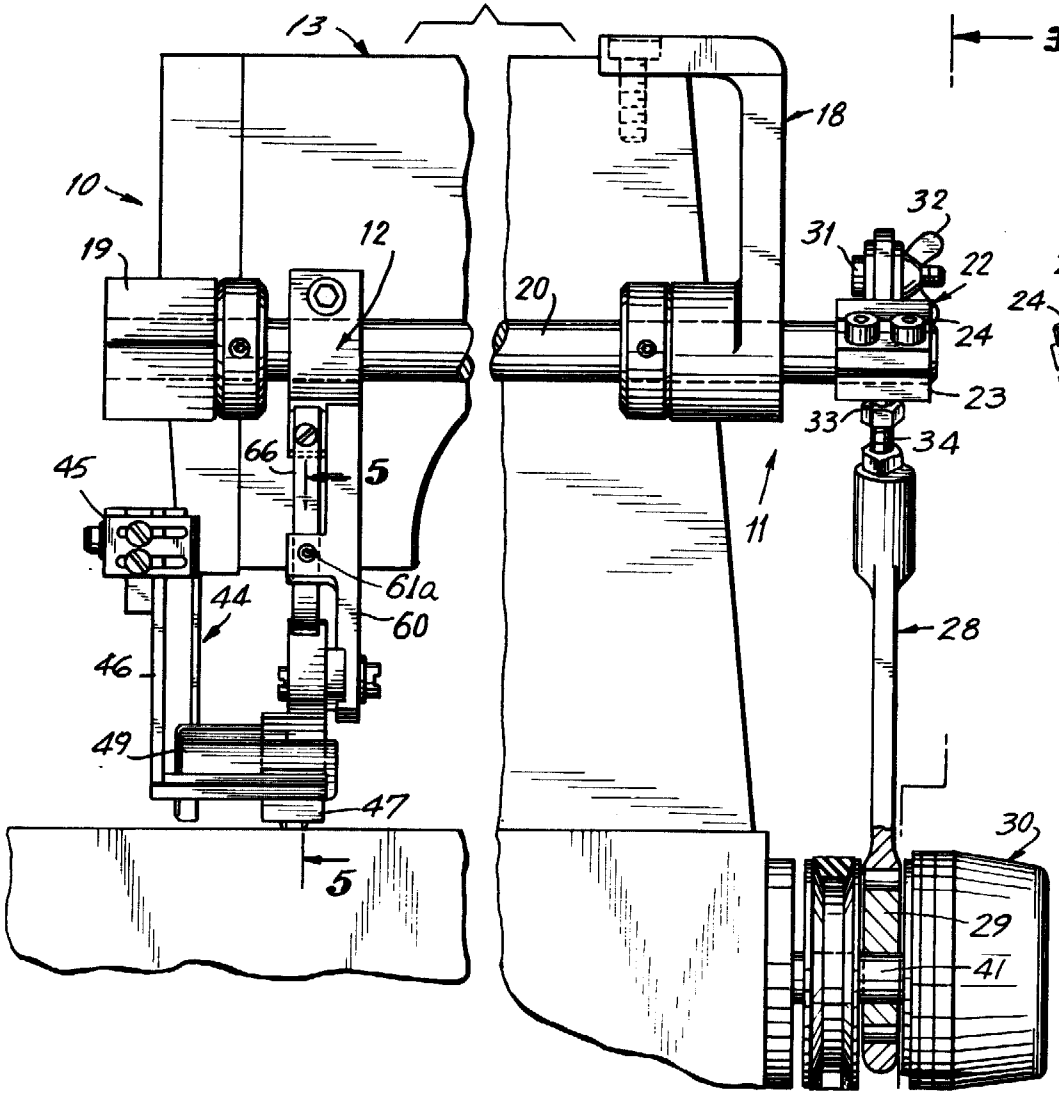
FIG. 2 is an elevational fragmented view of the ruffler attachment depicted in FIG. 1.
Figure 4:
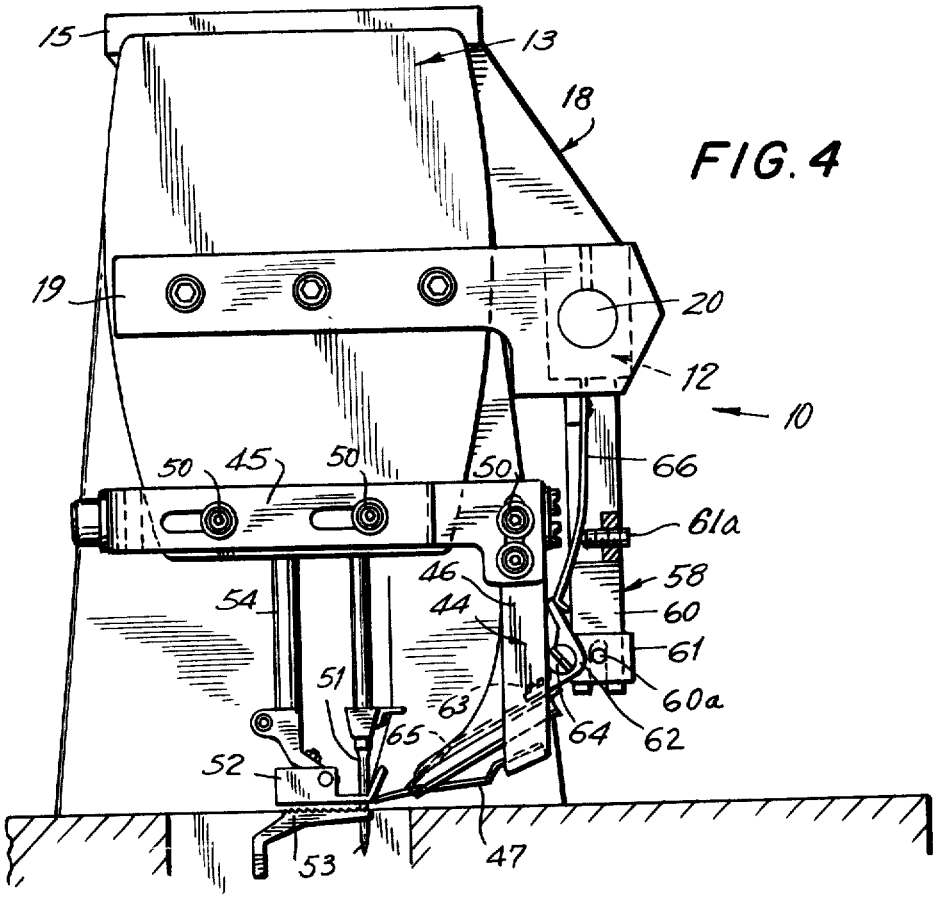
FIG. 4 is a side elevational view of the ruffler attachment depicted in FIG. 1.

Referring first to FIGS. 2, 3, and 4, the ruffler attachment oscillatory drive mechanism 11, and the manner in which same is mounted to sewing machine 13 and mechanically coupled to be driven by the sewing machine drive mechanism, is depicted. The oscillatory drive mechanism 11 is mounted to the sewing machine by a top-and-side mounting bracket 18 and a side mounting bracket 19. Brackets 18 and 19 rotatably support ruffler shaft 20. A calibrator, generally indicated at 22, is secured to ruffler shaft 20 by bracket portion 23 and bracket screw 24 and rotatably reciprocates shaft 20 in a manner to be discussed more fully below. The calibrator 22 further includes an elongated calibration feed arm 25 defining a calibration slot 26 therein. Calibration feed arm 25 is coupled to eccentric drive through an oscillatory drive arm, generally indicated as 28. Drive arm 28 includes an adjustable connecting yoke 33 coupled to feed arm 25 by a screw 31 and wing nut 32 extending through calibration slot 26 and yoke 33. The oscillatory drive arm 28 is coupled through a floating connection link 34 to an eccentric drive 29. Eccentric drive 29 is eccentrically mounted to a rotary drive mechanism generally indicated as 30, and effects the oscillatory displacement of drive arm 28 in a conventional manner.

The eccentric drive 29 is mechanically coupled to the machine main drive shaft 41, so that drive arm 28 is driven in an oscillatory manner to thereby effect an oscillatory driving of the calibration feed arm 25 in the direction indicated by the arrow in FIG. 3 to thereby articulate a likewise oscillatory rotation of ruffler shaft 20. As detailed with greater specificity below with respect to the operation of the instant invention, as the distance between the ruffler shaft 20 and the point at which the oscillatory drive arm 28 is secured to calibration feed arm 25 increases, the angle through which the ruffler shaft 20 is rotated proportionately decreases.

Figure 5:
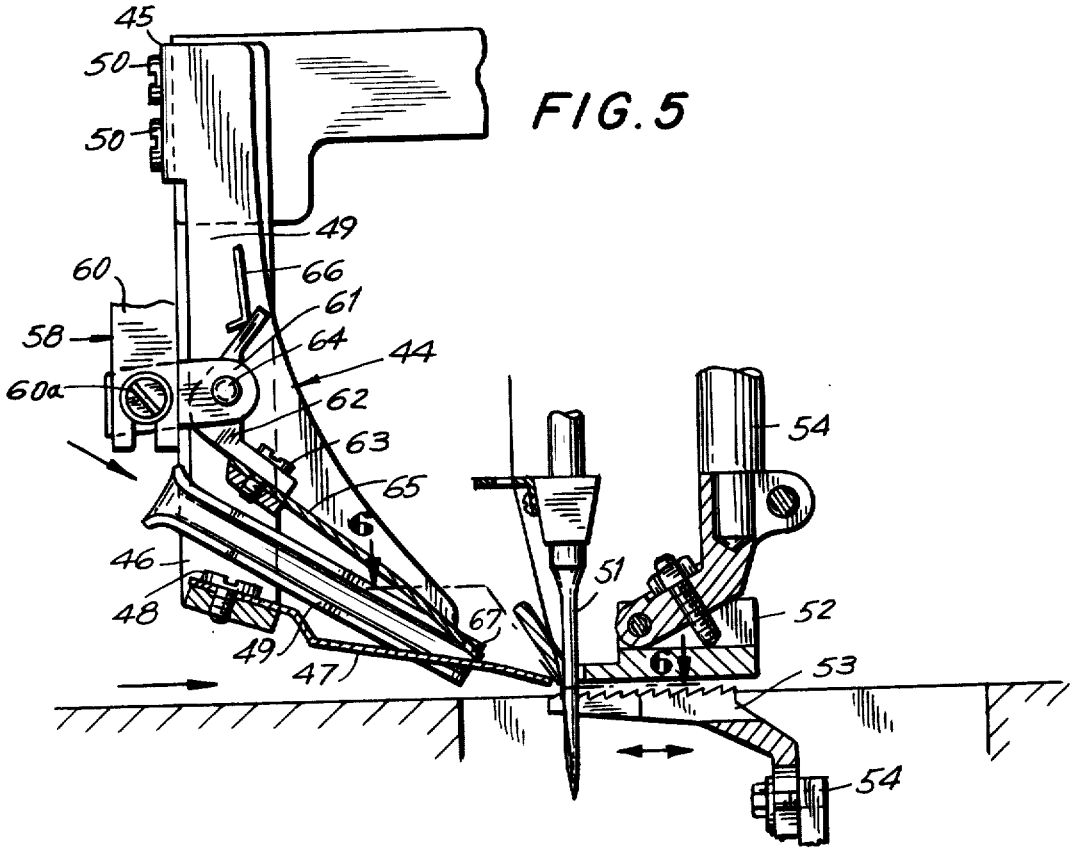
FIG. 5 is a sectional view taken along line 5—5 of FIG. 2.

Reference is now made to FIGS. 2, 4 and 5 wherein the ruffler assembly 12 is illustrated in detail. The ruffler assembly 12 includes a first stationary assembly, generally indicated as 44, secured to the sewing machine by mounting bracket 45 in a conventional manner. The stationary assembly 44 includes a stiffener blade support 46 for supporting a stiffener blade 47. The stiffener blade is secured to support 46 by a screw 48 and is positioned with respect to the sewing machine surface to provide sufficient clearance for the body fabric to be supplied thereunder during the ruffle operation. A feeder guide 49 is secured to mounting bracket 45 by screws 50 and is positioned to introduce the trim fabric into contact with the stiffener blade 47.

As is depicted in FIG. 4, the sewing machine includes the conventional elements for effecting a sewing operation including double needles 51, a presser foot 52, and feed dog 53. Feed dog 53 is supported by a feed dog drive member 54, which drive member is part of the feed dog drive mechanism (not shown), which mechanism operates in a conventional manner. Additionally, the presser foot 52 is secured to a presser foot support member 54, in a conventional manner. Accordingly, after each sewing operation by sewing needles 51, the feed dog 53 is displaced away from the sewing needle to advance the sewing fabric away from the needles and thereby position the sewn fabric for the next sewing operation, in a conventional manner.

Figure 6:
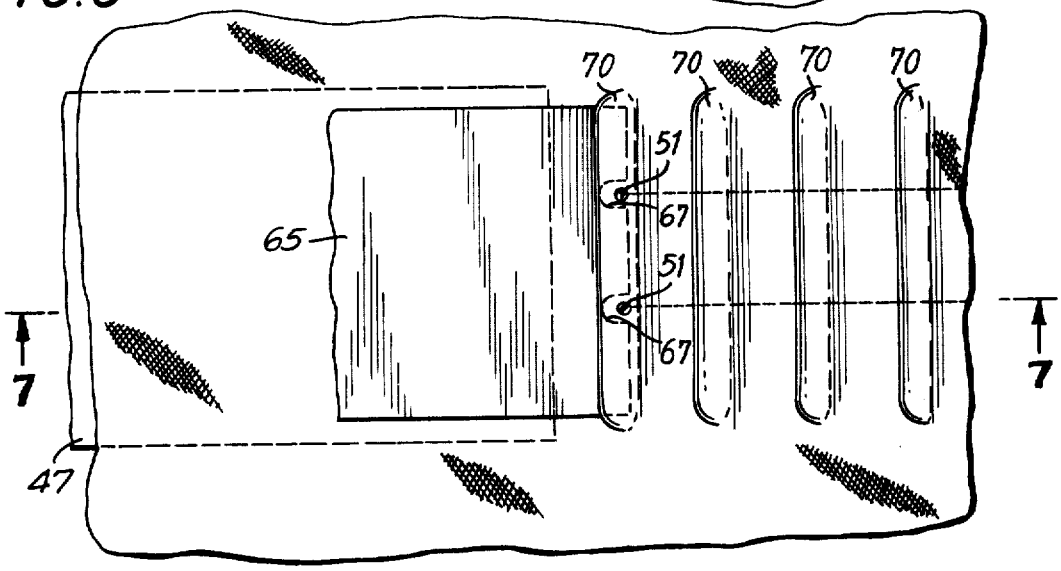
FIG. 6 is a fragmented plan view taken along line 6—6 of FIG. 5 and illustrating a ruffle forming operation.
Figure 7:
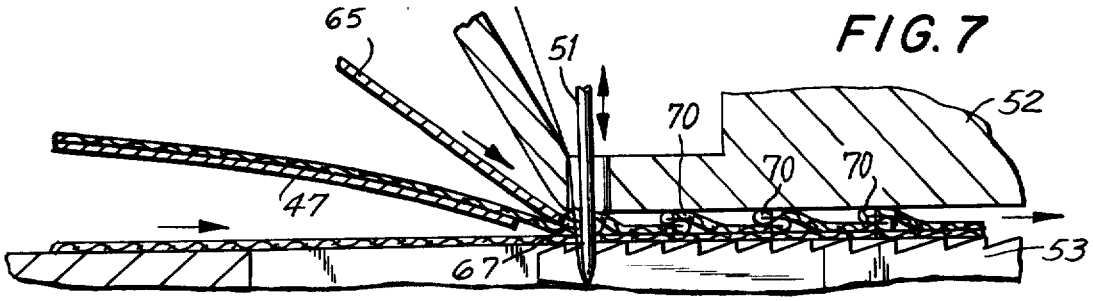
FIG. 7 is a partial sectional view taken along line 7—7 of FIG. 6.

Ruffler assembly 11 further includes a moving assembly, generally indicated as 58. Moving assembly 58 includes an oscillating lever 60 coupled to ruffler shaft 20 to be oscillated thereby. Oscillating lever 60 supports an abutment screw **61*a* and a positioning bracket 61, which positioning bracket 61 is secured to oscillating lever 60 by an adjustment screw 60*a*. Positioning bracket 61 supports ruffler blade mounting bracket 62 and is pivotally secured thereto by adjustment screw 64. Ruffler blade 65 is secured to ruffler blade support bracket 62 by screws 63, which screw resiliently dispose the ruffler blade 65 in contact with stiffener blade 47. In order to maintain the ruffler blade in resilient contact with stiffener blade 47, a resilient positioning spring 66 is secured to lever 60 and is disposed in abutting relationship by abutment screw 61*a* with ruffler blade mounting bracket 62 to thereby ensure that ruffler blade mounting bracket 62 continues to resiliently dispose the ruffler blade 65 in a downward direction. As is best illustrated in FIG. 6, ruffler blade 65 includes recesses 67 at the end thereof, which recesses 67 are disposed to permit the sewing needles 51** to pass therethrough when the ruffler blade is in a ruffle forming position to be explained below with respect to the operation of the instant invention.

In operation, ruffler shaft 20 is oscillated by calibration feed arm feed arm 25 in the manner described above, and effects an oscillatory displacement of oscillating lever 60 and hence ruffler blade 65. Accordingly, the body fabric 16 is displaced into contact with the needles and hence is passed under the stiffner blade 47. The trim fabric 15, which fabric is to be ruffled, is applied through the feeder guide 49 onto the stiffner blade 47, under the presser foot and therefore to the sewing position of the needles 51 to be sewn thereby. The ruffler blade 65 is resiliently positioned against the stiffner blade 47 proximate the point where the trim fabric 15 contacts the stiffner blade and sandwiches the trim fabric between the ruffler blade 65 to pinch the fabric at that position between the ruffler blade 65 and stiffner blade 47. As the ruffler shaft oscillates, the ruffler blade is displaced toward the needle to the position indicated in FIG. 6, so that the recesses 67 permit clearance for the needles to enter the trim and body fabrics. The ruffler blade forces the pinched portion of the fabric under the remaining portion of the fabric between the point at which the blade contacts the trim fabric and the sewing position of the needle 51, and forms a pleat 70 thereby. The ruffler blade is synchronized to form the pleat just prior to the downward displacement of the sewing needles 51 so that the sewing needles stitch the pleat formed by the ruffler blade in the usual manner to thereby form a widthwise pleat and effect a ruffling of the trim fabric. Accordingly, as the feed dog displaces the sewn together trim fabric and body fabric away from the sewing needle to prepare the respective fabrics for the next sewing operation by sewing needles 51, the ruffler blade is returned to the initial position of the pleat-forming stroke by the oscillatory motion of ruffler shaft 20, whereafter same is once again displaced and continues to complete period ruffling operations.

The oscillatory drive mechanism 11 is characterized by the facility with which same is coupled to the main drive shaft of a sewing machine and is capable of regulating the ruffling operation performed by the ruffler assembly 12. By providing calibration indicia on the calibration feed arm 25, the position at which the oscillatory drive arm 28 is coupled to feed arm 25 can be varied, thereby varying the angle through which the ruffler shaft 20 is rotated, and hence correspondingly varying the distance through which the ruffler blade 65 is displaced during each oscillation of the ruffler shaft 20. The shorter the displacement of the ruffler blade 65, the shorter the pleat 70 formed thereby. Accordingly, the calibration feed arm 25 facilitates the adjustment of the length of the pleat used to form the ruffle without requiring extensive modification of the ruffler mechanism or sewing machine mechanism. Moreover, the oscillatory drive mechanism effects synchronization of the movement of the ruffler blade with the movement of the sewing needle, and feed dog of the sewing machine, to provide the improved ruffler forming operation detailed above.

Figure 8:
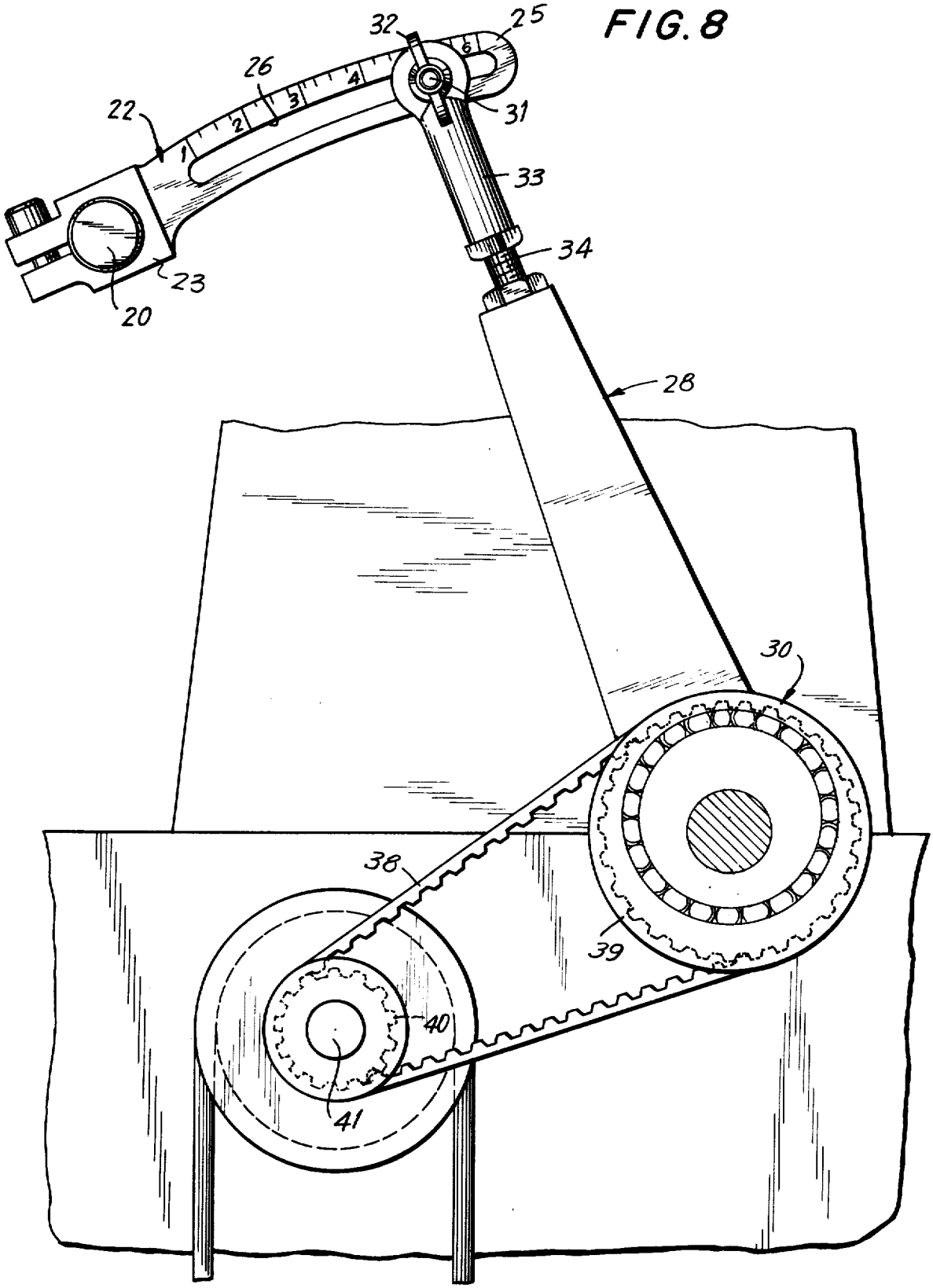
FIG. 8 is a partial sectional view of a skip pleat drive feature of the ruffler mechanism depicted in FIG. 1.

Reference is now made to FIG. 8 wherein a skip pleat drive embodiment of the ruffler mechanism is depicted, like reference numerals being utilized to denote like elements depicted above. Rotary drive mechanism 30 includes a driven timing pulley 39 coupled by a timing belt 38 to a driving timing pulley 40 coupled to the main drive shaft 41 of the sewing machine. The oscillatory drive mechanism, by properly selecting the gear ratio between the driven timing pulley 39 and driving pulley 40 can effect a forming of a ruffle pleat on every other sewing cycle of the sewing needle by incorporating a 2 to 1 drive from the main shaft. If, for example, the driving timing pulley 40 is provided with 18 gear teeth, and the driven timing pulley 39 is provided with 36 gear teeth, a skip pleat feature is provided. Accordingly by utilizing interchangeable driving and driven timing pullies, the number of ruffles formed in each predetermined distance of body fabric is affected. Moreover, the length of each pleat and the number of pleats for a predetermined length of body fabric is readily adjusted in accordance with the instant invention.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A ruffler assembly for use in a sewing machine having needle means including a needle, said needle means effecting periodic sewing displacement of said needle into a material to effect sewing of same, feed dog means including a feed dog constructed and arranged with respect to said needle to effect periodic displacement of said fabric after each sewing displacement of said needle, and rotary driving means coupled to said needle means and feed dog means for synchronizing the periodic fabric sewing and displacement operations respectively performed by said needle and feed dog means, said ruffler assembly comprising in combination a stiffener blade disposed to permit a body material to be introduced thereover into the sewing position of said needle to effect sewing thereof, feeder means for effecting the feeding of a trim material into contact with said stiffener blade, and a ruffler blade coordinately displaceable from a stiffener blade contact position to a ruffle-forming position proximate said needle sewing position, said ruffler blade at said first stiffener blade contact position being constructed and arranged to sandwich a portion of said trim material between said ruffler blade and said stiffener blade and thereby effect a folding of a portion of said trim material between the first stiffener blade contact position and sewing displacement position of said needle under the remaining portion of said trim fabric between said stiffener blade contact position and sewing displacement position of said needle, and oscillatory drive means coupled to said ruffler blade means and to said sewing machine rotary drive means for synchronizing said coordinate displacement of said ruffler blade from said first contact position to said ruffle forming position with said periodic sewing displacement of said needle and periodic displacement of said material by said feed dog, said oscillatory drive means further including ruffler shaft means coupled to the ruffler blade means, and calibration means disposed intermediate the main sewing machine drive shaft and the ruffler shaft means for oscillating the ruffler shaft means to a predetermined rotational angle, the extent of the rotational angle through which said ruffler shaft means is rotated defining the distance through which said ruffler blade is coordinately displaced during each ruffle forming operation, said oscillatory driving means also including eccentric drive means coupled to said calibration means for displacing said ruffler shaft means through a predetermined rotational angle during each ruffle forming operation, said eccentric driven means including a driven pulley, said sewing machine rotary drive means including a driving pulley, and a belt coupled to said driving pulley and driven pulley to effect driving of said driven pulley thereby, the gear ratios between said drive pulley and said driven pulley being selectively variable so that said variable gear ratios determine the number of pleats to be formed for each sewing operation of said sewing needle.

2. A ruffler assembly as claimed in claim 1, wherein said calibration means includes a calibration feed arm coupled to said ruffler shaft means, said calibration feed arm including operative means for adjusting the position at which the calibration feed arm is coupled thereto, and hence the rotational distance through which the calibration feed arm is displaced during each stroke of said eccentric drive means.

3. A ruffler assembly as claimed in claim 2, wherein said calibration feed arm operative means includes arcuate slot and indicia disposed along said arcuate slot means for indicating the respective coupling positions therealong.

4. A ruffler assembly as claimed in claim 2, wherein said eccentric drive means includes an eccentric drive arm coupled to said calibration feed arm, and eccentric driven means adapted to be coupled to said sewing machine rotary drive means.

5. A ruffler assembly as claimed in claim 4, wherein the radial distance between said ruffler shaft and the position at which said eccentrically driven drive arm is coupled to said calibration lever arm inversely affects the rotational distance through which said ruffler blade means is coordinately displaced.

6. A ruffler assembly as claimed in claim 4, wherein said ruffler blade means includes an elongated blade and resilient mounting means coupled to said ruffler shaft means for securing a first lengthwise end of said ruffler blade and positioning the free lengthwise end of said ruffler blade in resilient contact with said stiffener blade at a first contact position of the stiffener blade to effect said sandwiching of said trim material thereby.

7. A ruffler assembly as claimed in claim 6, wherein said free lengthwise end of said ruffler blade includes at least one recess therein, said recess providing clearance for said sewing needle when the free end of said ruffler blade is coordinately displaced to a ruffle forming position past said needle sewing position.

* * * * *